US008283544B2

(12) United States Patent
Zuffante et al.

(10) Patent No.: US 8,283,544 B2
(45) Date of Patent: Oct. 9, 2012

(54) AUTOMATIC DRUM TUNER

(75) Inventors: Daniel Zuffante, New York, NY (US); Vishal Kumar, New York, NY (US); Reid Ellison, New York, NY (US); Edward Joseph Baronowski, New York, NY (US); Emmanuel S. Milienos, Astoria, NY (US)

(73) Assignee: The Trustees of Columbia University in the City of New York, New York, NY (US)

( * ) Notice: Subject to any disclaimer, the term of this patent is extended or adjusted under 35 U.S.C. 154(b) by 0 days.

(21) Appl. No.: 13/087,679

(22) Filed: Apr. 15, 2011

(65) Prior Publication Data

US 2011/0252943 A1 Oct. 20, 2011

Related U.S. Application Data

(60) Provisional application No. 61/324,637, filed on Apr. 15, 2010.

(51) Int. Cl.
*G10G 7/02* (2006.01)

(52) U.S. Cl. ..... 84/454; 84/458; 84/413

(58) Field of Classification Search ..... 84/413, 84/454, 458

See application file for complete search history.

(56) References Cited

U.S. PATENT DOCUMENTS 3,144,802 A * 8/1964 Faber, Jr. et al. ..... 84/454
3,750,466 A * 8/1973 Ott et al. ..... 73/159
4,023,462 A * 5/1977 Denov et al. ..... 84/454
4,287,806 A * 9/1981 Neary ..... 84/458
4,453,448 A * 6/1984 Miesak ..... 84/454
4,741,242 A * 5/1988 Aronstein ..... 84/454
4,791,849 A * 12/1988 Kelley ..... 84/458
5,157,212 A * 10/1992 Fleming ..... 84/413
5,323,680 A * 6/1994 Miller et al. ..... 84/455
5,392,681 A * 2/1995 Hall ..... 84/413
5,394,775 A * 3/1995 Fagerstrom ..... 81/479
5,533,405 A * 7/1996 Hoshino ..... 73/760
5,770,810 A * 6/1998 Lombardi ..... 84/411 R
D412,011 S * 7/1999 Rice et al. ..... D17/20

(Continued)

OTHER PUBLICATIONS

DrumDial, Jun. 6, 2002, printed from www.drumdial.com, Apr. 15, 2011.

(Continued)

*Primary Examiner* — David Warren
*Assistant Examiner* — Robert W Horn
(74) *Attorney, Agent, or Firm* — Wiggin and Dana LLP; Anthony P. Gangemi

(57) ABSTRACT

Methods and systems for automatically tuning a drum are disclosed. In some embodiments, the methods and systems include the following: (a) exciting a drum head to cause it to resonate; (b) sensing a vibration frequency at one or more points relative to each tension rod; (c) determining a global average vibration frequency of the vibration frequencies for the points relative to each tension rod; (d) comparing the vibration frequencies of each of the points relative to each tension rod to the global average vibration frequency to determine a correction value for each point relative to the global average vibration frequency; (e) automatically turning each tension rod based on the correction value for the relative points; (f) automatically repeating steps (a)-(e) until each of the vibration frequencies of each of the points relative to each tension rod is substantially similar; and (g) automatically turning each tension rod in a uniform direction substantially simultaneously.

20 Claims, 6 Drawing Sheets

U.S. PATENT DOCUMENTS

| | | | | |
|---|---|---|---|---|
| 6,066,790 | A * | 5/2000 | Freeland et al. | 84/454 |
| 6,294,719 | B1 * | 9/2001 | Palecki et al. | 84/458 |
| 6,812,392 | B2 * | 11/2004 | Brando | 84/411 R |
| 6,925,880 | B1 * | 8/2005 | Roberts | 73/587 |
| 7,488,882 | B2 * | 2/2009 | Curet Troche | 84/411 R |
| 7,495,161 | B1 * | 2/2009 | Richards | 84/411 R |
| 7,888,568 | B2 * | 2/2011 | Kashioka | 84/41 |
| 8,008,560 | B2 * | 8/2011 | Wiese et al. | 84/411 R |
| 2011/0252943 | A1 * | 10/2011 | Zuffante et al. | 84/413 |

OTHER PUBLICATIONS

Digital DrumDial, printed from www.drumdial.com, Apr. 15, 2011.
Resotune Electronic Drum Tuner, Circular Science, printed Apr. 15, 2011.
TW100 Tension Watch, Tama, printed Apr. 15, 2011.
Torque Drum Key, printed from www.evansdrumheads.com, Apr. 15, 2011.
Protorq Precision Drum Key, printed from www.rhythmtech.com, Apr. 15, 2011.

* cited by examiner

AUTOMATIC DRUM TUNER

CROSS REFERENCE TO RELATED APPLICATION(S)

This application claims the benefit of U.S. Provisional Application No. 61/324,637, filed Apr. 15, 2010, which is incorporated by reference as if disclosed herein in its entirety.

BACKGROUND

The most common way to tune a membranous percussive musical instrument usually involves manually adjusting the tension of the membrane in order to achieve the desired frequency. In the case of a drum, the resonant frequency of the drum depends on the tension of the membrane or drum head, which is stretched over and joined with a shell by a hoop/ring that is fastened to lugs on the shell by uniformly spaced bolts, which are commonly referred to as tension rods. The first step in tuning a drum is to "clear" the drum head. This process involves equalizing the tension of the drum head near each tension rod to achieve a uniform vibration throughout the entire drum head. Once this is complete, the drum has uniform resonant properties, which result in a clear tone when excited, and can then be tuned to the desired frequency, i.e., note. This process is fairly time consuming and relies on the expertise and judgment of the user to achieve an accurate result.

There are approximately 18 million people in the United States who currently play drums. Unlike other instruments, for example a guitar, drums are very difficult to tune to a desired note. In order to tune a guitar, the tension in each string is adjusted separately in order to achieve the correct frequency. A drum cannot be tuned the same way. A drum head has six or eight tension rods, which sit on the outside of the drum head and are joined with corresponding lugs that are on the outside of the drum shell. When one of these tension rods is tightened or loosened, it will change the tension in the drum head. When the tension at one of these tension rods is adjusted, it will affect the entire drum head, not just the area of the drum head adjacent the particular tension rod. This is a time consuming and imprecise method.

Because of the complexity of tuning a drum, there is very little literature beyond the instructions for manually tuning a drum. An example of step-by-step manual instructions for tuning a drum include the following:

1. Choose a tension rod to act as your model tension rod, this will be how you know you have tuned all the tension rods on each tuning pass;
2. Tap the drum head with the stick gently, approximately 2 inches from the tension rod in the direction of the center of the drum, this is your test tone;
3. Continuing with the tension rod on the opposite side of the drum from the model tension rod, tap on the head gently. Using a standard drum key, a hand tool for turning tension rods as known in the art, turn the tension rod until the tone is the same as the original tone;
4. Moving in a star formation tap on the drum head by the next tension rod;
5. Repeat step 3;
6. Repeat step 4 followed by step 3 until you have returned to the model tension rod; and
7. Now test the tone of the center of the drum. If you are satisfied with the tone, then you are done. If not satisfied, then again starting with the model tension rod, turn each tension rod one-quarter turn moving clockwise around the drum until you reach the model tension rod again.

Existing products that assist a user to tune a drum reliably using resonant frequency technology are not autonomous and force the user to manually tune the drum. One such product acquires the frequency at each tension rod by using a speaker to drive the drum and a microphone to measure the resonant response. It stores all of the frequencies as the user manually rotates the device from tension rod to tension rod and chooses a mean value that one must tune to in order to clear the drum head. The user can then choose a frequency that he or she wants and turn the lug until the device says it is there. However, this requires that the user iteratively repeat this process of rotating and collecting data until he or she has achieved the desired result.

Another known product is an adjustable release torque wrench. The wrench releases at a mechanically determined torque limit. The user, therefore, must turn each lug until the wrench releases, resulting in the torque in each lug being equal. The downside of this design, however, lies in the assumption that torque will directly correlate to tension on the membrane. This would only prove successful if the friction in each lug was equal. In actuality, and as proved in testing, the friction in each lug will vary significantly depending on the level of lubrication and tolerance fit of the actual thread fit. The user is therefore limited to an inaccurate method that relies on unrealistic assumptions.

SUMMARY

Some embodiments of the disclosed subject matter include an automatic drum tuner system. In some embodiments, a spring-loaded, adjustable, locking mechanism that is rotated via engagement with a shaft of a motor is used to ensure the system mounts onto each of the drums tension rods. The locking mechanism is independent of the motor shaft's position. The system is supported by a mechanical frame including adjustable length arms, all with locking pins. In addition, a bipolar stepper motor is mounted to each arm. Geared up 30 times in some embodiments with a worm gear to spur gear connection, the mechanism will allow for the usage of a lower profile stepper-motor. A solenoid mechanism mounted to the frame is configured to strike the drum head to cause it to resonate. In some embodiments, instead of striking the drum head, a speaker is used to excite the drum head and cause it to resonate. Piezoelectric transducers mounted in proximity of each tension rod measure the local frequency near each tension rod. A fast Fourier transform (FFT) or similar algorithm is performed on each output signal to calculate the resonant frequency at that specific point on the drum membrane. Once the fundamental frequencies are calculated for all locations, clearing of the drum head begins. A control system reads the frequencies and measures the peak energy values of the first four fundamental modes. Each of these values from each piezoelectric sensor is stored into a matrix. Using this matrix, a global average is established and each tension rod is assigned a positive or negative value relative to this global mean. Each stepper motor then completes a predefined series of steps either clockwise, or counterclockwise, depending on the relative value assigned to that tension rod. Using an iterative process, the system directs each tension rod to turn in an appropriate manner until the drum head is "clear." Once cleared, each motor can be simultaneously activated in a uniform direction to change the overall frequency, i.e., musical note, of the drum head.

BRIEF DESCRIPTION OF THE DRAWINGS

The drawings show embodiments of the disclosed subject matter for the purpose of illustrating the invention. However, it should be understood that the present application is not limited to the precise arrangements and instrumentalities shown in the drawings, wherein.

DETAILED DESCRIPTION

Figure 1:
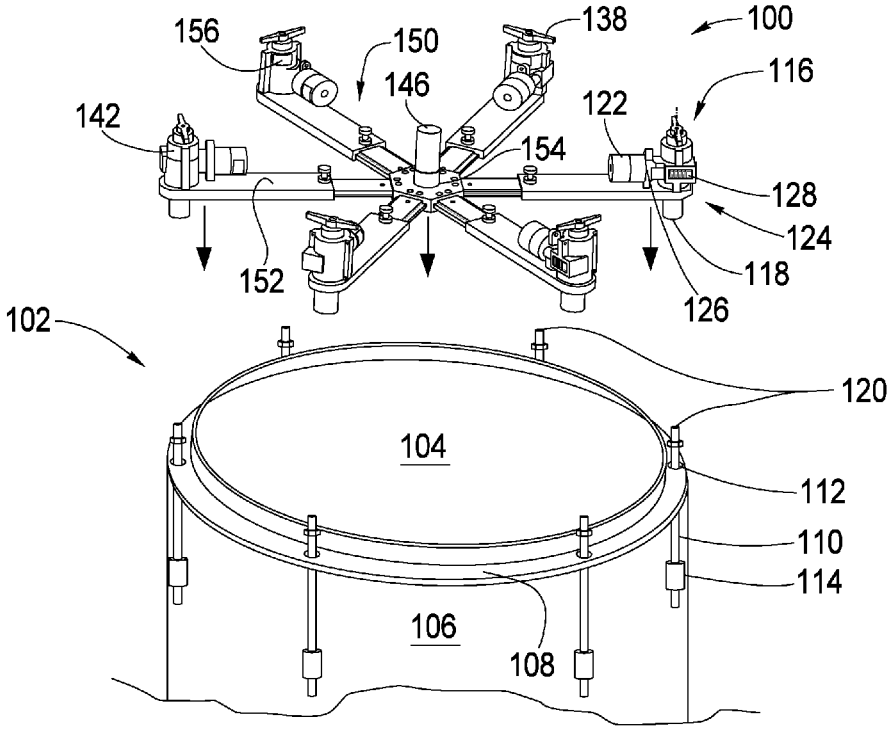
FIG. 1 is a front, isometric exploded view of a diagram of systems according to some embodiments of the disclosed subject matter.
Figure 2:
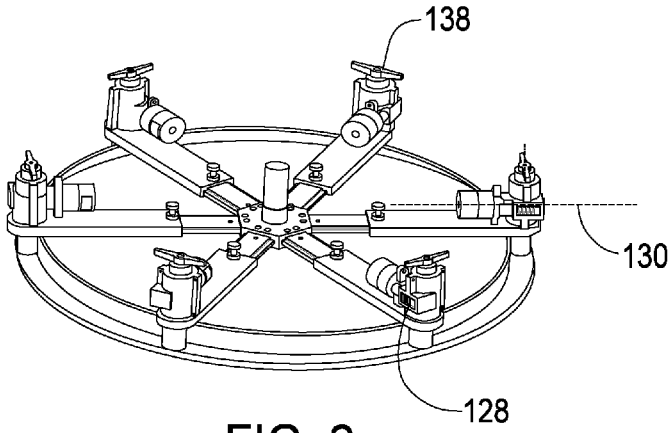
FIG. 2 is a front isometric diagram of systems according to some embodiments of the disclosed subject matter.

Referring now to FIGS. 1-8, aspects of the disclosed subject matter include systems and methods for automatically adjusting the tension of a membrane whose surface tension is adjusted using tension rods. Referring now to FIGS. 1 and 2, some embodiments include an automatic drum tuning system 100 for a drum 102 having a drum head 104 mounted between a drum shell 106 and a drum hoop 108 using threaded tension rods 110 inserted through holes 112 in the drum hoop that are joined to threaded lugs 114 that are connected to the drum shell.

Figure 6:
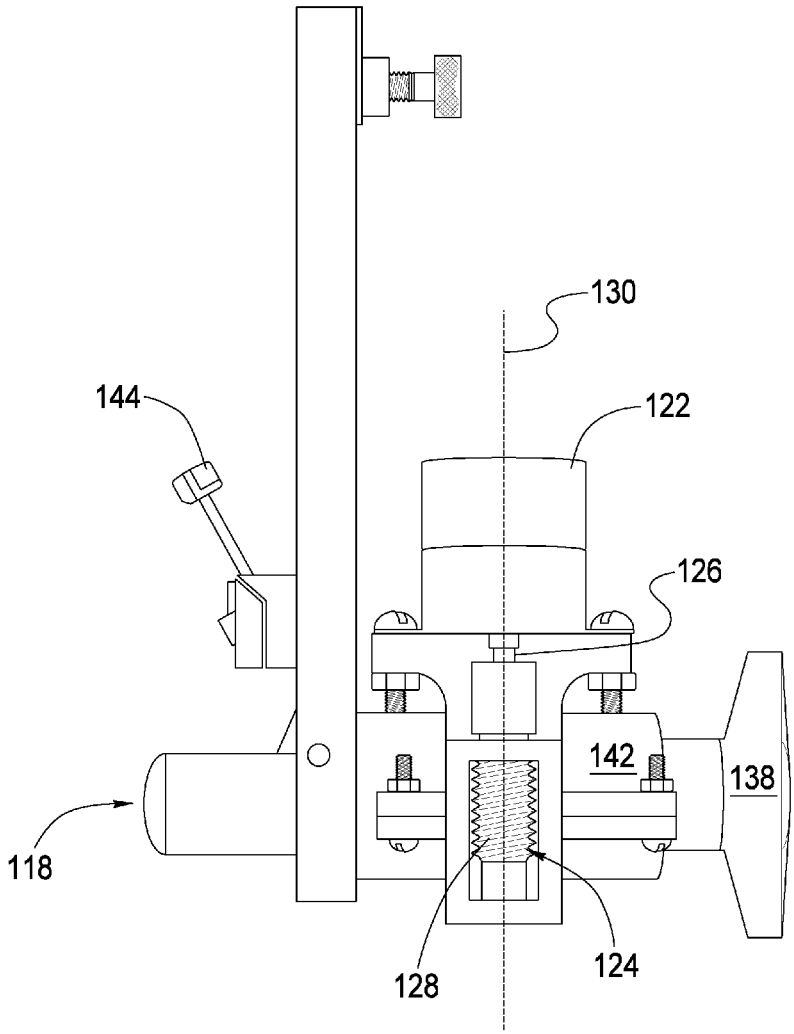
FIG. 6 is a enlarged side view of a portion of systems according to some embodiments of the disclosed subject matter.
Figure 7:
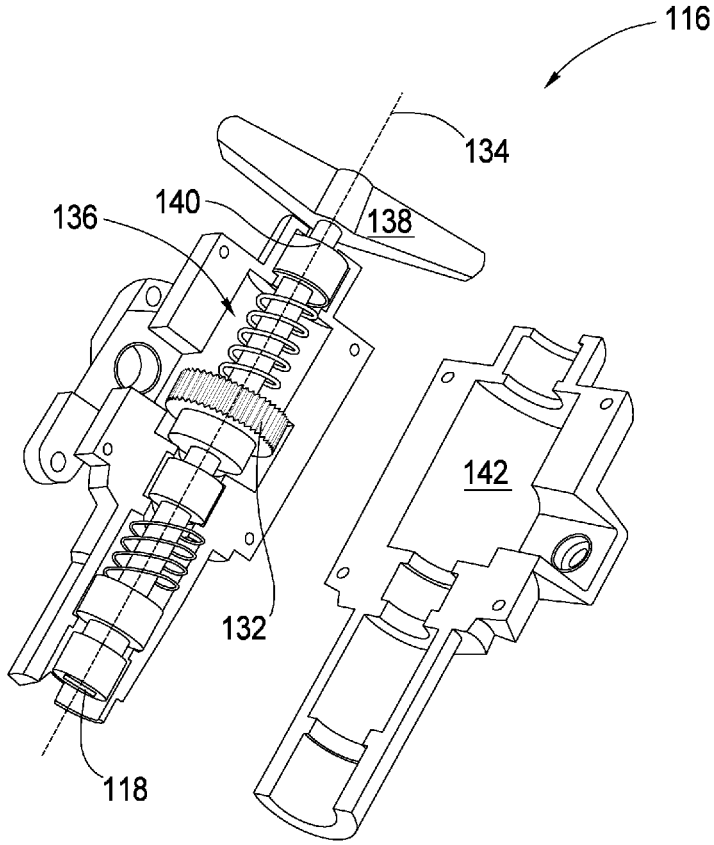
FIG. 7 is a enlarged, exploded side view of a portion of systems according to some embodiments of the disclosed subject matter.

In some embodiments and shown in FIG. 7, system 100 includes tension rod adjustment members 116, each of which includes a connection end 118 that is configured to releasably join with a top end 120 of tension rods 110 to rotate the tension rods. As best shown in FIG. 6, each of motors 122 is joined with one of tension rod adjustment members 116 via a geared connection 124. In some embodiments, motors 122 are stepper motors, e.g., in some embodiments a unipolar 13.3V stepper motor, operated at 24 volts is used. Motors 122 are configured to automatically rotate tension rod adjustment members 116. Motors 122 include a shaft 126 that is joined with a first gear 128. First gear 128, which is a worm gear in some embodiments and is part of geared connection 124, is axially mounted to shaft 126 with respect to a longitudinal axis 130 of shaft 126. As shown in FIG. 7, geared connection 124 includes a second gear 132 axially mounted with respect to a longitudinal axis 134 of each of tension rod adjustment members 116. In some embodiments, second gear 132 is a spur gear. First and second gears 128 and 132 are typically configured to provide a predetermined torque in combination with one of motors 122 that is sufficient to rotate one of tension rods 110.

Still referring to FIG. 7, each of tension rod adjustment members 116 includes a mechanism 136 for engaging and disengaging first and second gears 128 and 132. When system 100 is positioned on drum 102, each of tension rods 110 will be at an arbitrary angle. When engaged, first and second gears 128 and 132 do not allow rotation of tension rod adjustment members 116. Mechanism 136 allows for temporary disengagement of first and second gears 128 and 132 so that a user can initially align each of connection ends 118 of tension rod adjustment members 116 with a respective top end 120 of tension rods 110 regardless of the initial angle of the tension rod. Tension rod adjustment members 116 are configured so as to be rotatably adjustable when first and second gears 128 and 132 are disengaged to allow the members to be initially joined with tension rods 110 regardless of the rods axial position. Typically, a spring-loaded handle 138 is mounted to a top portion 140 of each of tension rod adjustment members 116 to allow a user to disengage first and second gears 128 and 132 and allow manual rotation of the members by a user. After each of connection ends 118 is joined with a respective one of top ends 120, each of tension rod adjustment members 116 is configured to automatically engage first and second gears 128 and 132.

In some embodiments, each of tension rod adjustment members 116 includes an external housing 142. Also, in some embodiments, connection ends 118 are spring-loaded, which causes each of the connection ends to retract into a respective housing 142 when not aligned with a respective one of top ends 120. As mentioned above, handle 138 is used to disengage first and second gears 128 and 132. Handle 138 can than rotate freely, turning a respective one of connection ends 118. Once connection end 118 matches top end 120 of tension rod 110, it will snap into place and handle 138 can then be released. Since handle 138 is spring loaded, it will retract and cause the automatic engagement of first and second gears 128 and 132.

Referring again to FIG. 6, in some embodiments, system 100 includes vibration sensors 144, each of which is configured to be positioned on drum head 104 adjacent one of tension rods 110 to measure a vibration frequency adjacent the tension rod. In some embodiments, vibration sensors 144 are piezoelectric vibration transducers such as model MSP1007-ND manufactured by Measurement Specialties, Inc. Piezoelectric transducers produce a voltage in proportion to the mechanical stress applied to a material. They are available in a small and inexpensive tab-like form, require no power supply, and produce large voltages that avoid the need for pre-amplification.

In some embodiments, vibration sensors 144 are not positioned adjacent one of tension rods 110, e.g., sensors are placed half-way between each tension rod instead. In addition, there need not be a 1:1 correlation of vibration sensors 144 to tension rods 110. In some embodiments, the number of vibration sensors 144 is greater than the number of tension rods 110. Regardless of the number of vibration sensor 144, the signal coming from each sensor is localized to achieve a gradient of the resonance.

Referring again to FIGS. 1-5, in some embodiments, system 100 includes an automatic excitation member 146 configured to automatically cause drum head 104 to resonate. In some embodiments, automatic excitation member 146 includes a solenoid mechanism or similar joined with a striking pin 147. Striking pin 147 strikes drum head 104 thereby causing it to resonate. In some embodiments, automatic excitation member 146 causes drum head 104 to resonate without contacting the drum head, e.g., excitation via a speaker.

Figure 3:
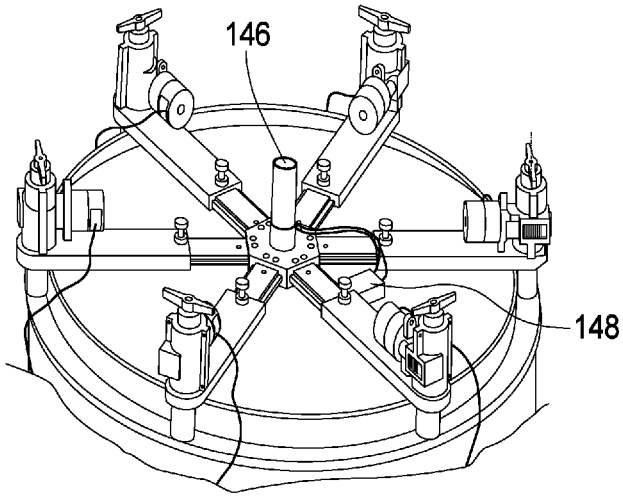
FIG. 3 is a front isometric view of systems according to some embodiments of the disclosed subject matter.
Figure 4:
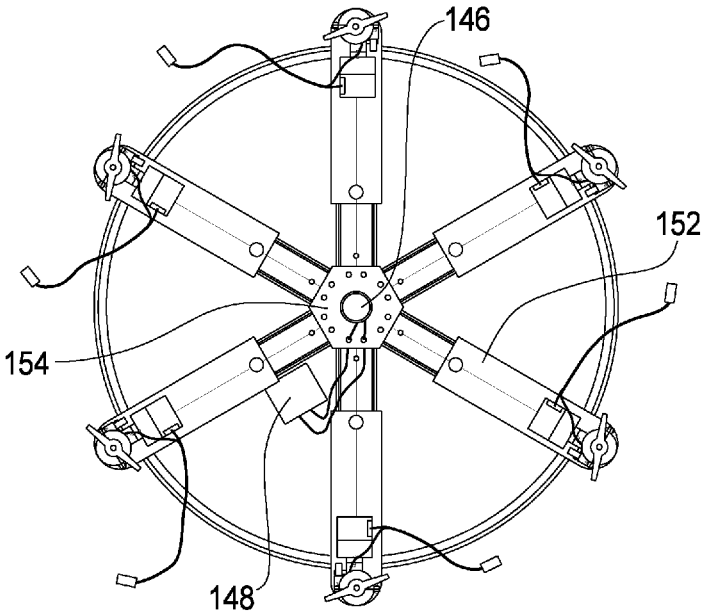
FIG. 4 is a top view of systems according to some embodiments of the disclosed subject matter.
Figure 5:
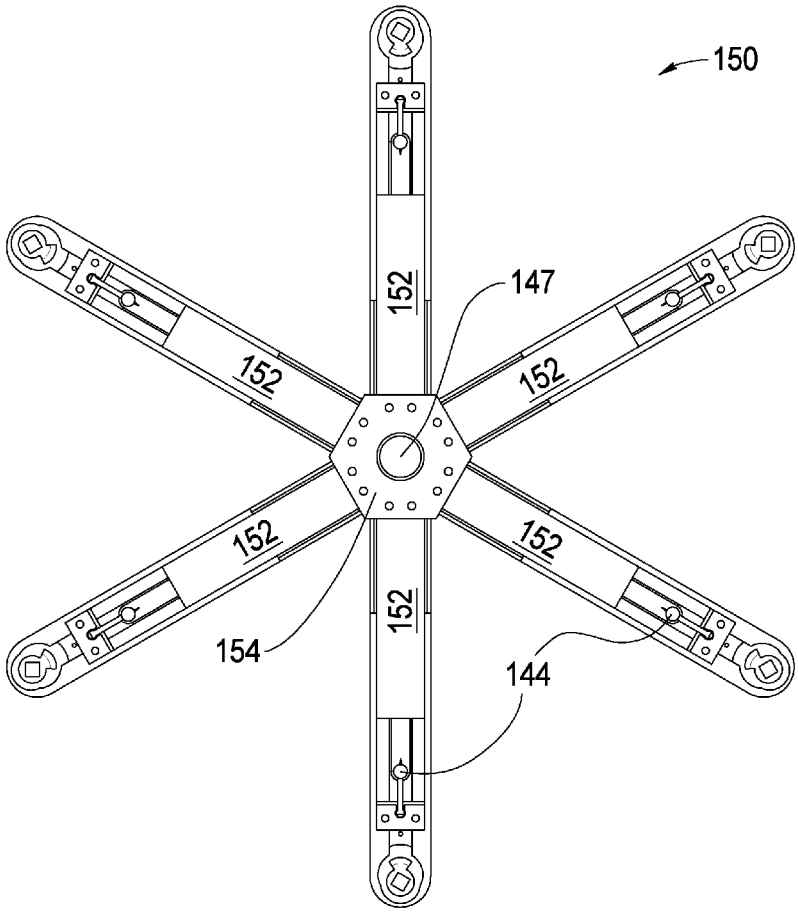
FIG. 5 is a bottom view of systems according to some embodiments of the disclosed subject matter.

As shown in FIGS. 3 and 4, in some embodiments, system 100 includes a control module 148 for controlling automatic excitation member 146 and motors 118 based on data received from vibration sensors 144. In some embodiments control module 148 includes a dsPIC 33FJ128MC706 series microcontroller as manufactured by Microchip Technology Inc. Upon the automatic strike of the drum, control module 148 records a predetermined sample, e.g., 500 ms, of data from each of vibration sensors 144 substantially simultaneously. In some embodiments, because system 100 is typically looking at the frequencies below 1 KHz, the system samples at 4 KHz rate and stores 2048 samples for the 500 ms sound clip. Then, control module 148 performs an FFT on each signal and compares between each input of data from vibration sensors 144 the location of the frequency bins where peak values occur for variability detection. Depending on what tuning stage is in progress, i.e., clearing or pitch adjustment, control module 148 then outputs the proper control signals to activate either automatic excitation member 146, a particular one of motors 118, or all of the motors.

In some embodiments, system 100 includes a mechanical frame 150 that has adjustable and lockable arms 152 joined by a center portion 154. Each of arms 152 is configured to receive at least one of tension rod adjustment members 116, one of motors 118, one of vibration sensors 144. Center portion 154 is typically configured to receive automatic excitation member 146.

In some embodiments, system 100 includes a visual display 156 in communication with each of vibration sensors 144. Each visual display 156 displays the vibration frequency measured by an adjacent one of vibration sensors 144 and can be any known display technology in the art suitable for such an application. Visual display 156 is typically mounted to housing 142.

Figure 8:
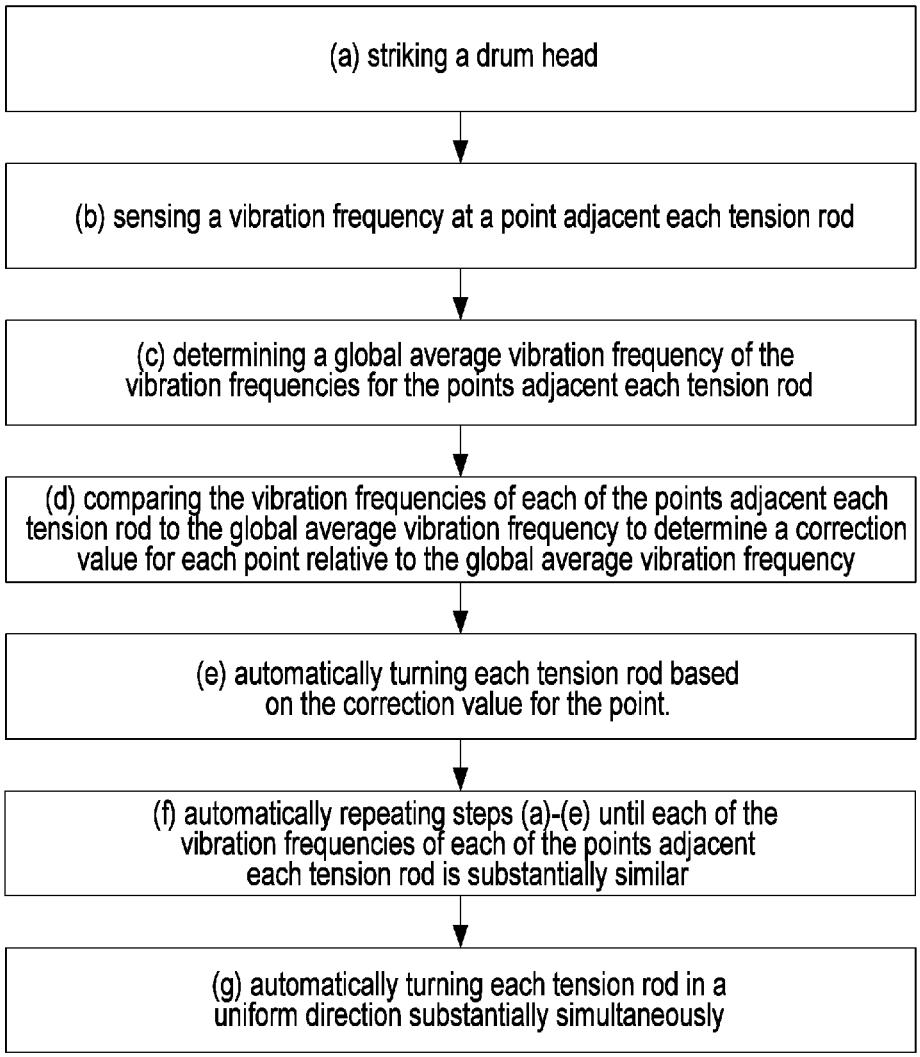
FIG. 8 is a chart of methods according to some embodiments of the disclosed subject matter.

Referring now to FIG. 8, some embodiments include a method 200 of automatically tuning a drum having a drum head mounted between a drum shell and a drum hoop using threaded tension rods inserted through holes in the drum hoop that are joined to threaded lugs that are connected to the drum shell. At 202, a drum head is struck or otherwise caused to resonate. At 204, a vibration frequency at one or more points relative to, e.g., typically adjacent, each tension rod is sensed. At 206, a global average vibration frequency of the vibration frequencies for the points relative to each tension rod is determined. At 208, the vibration frequencies of each of the points relative to each tension rod are compared to the global average vibration frequency to determine a correction value for each point relative to the global average vibration frequency. At 210, each tension rod is automatically turned based on the correction value for the points relative to each tension rod. At 212, steps 202 thru 210 are automatically repeating until each of the vibration frequencies of each of the points relative to each tension rod is substantially similar. At 214, each tension rod is automatically turned in a uniform direction at substantially the same time.

The disclosed subject matter offers benefits over known designs. Our drum tuner will automatically equalize the tension in the drum head and allow the user to raise or lower the pitch.

The automatic drum tuner however, will be displacement controlled, not force, and will deliver a step that directly corresponds to the local measured frequency, and therefore tension, in the drum membrane. The consistency, accuracy, and affordability of the automatic drum tuner will surpass all existing drum tuners on the current market.

While common in practice, manual drum tuning is tedious and time-consuming, and achieving accurate pitch on a consistent basis is highly dependent on the user's expertise and judgment. This technology describes an electromechanical device that, when fixed to a standard sized drum, e.g., such as a tom, will automatically tune the drum tom according to user specifications. In contrast to manual tuning (which adjusts each drum head lug in a serial manner), this portable and autonomous device first equalizes the tension of the drum's membrane throughout the entire drum head, and then tunes the drum to the desired frequency by simultaneously addressing all drum head tension rods and lugs.

Although the disclosed subject matter has been described and illustrated with respect to embodiments thereof, it should be understood by those skilled in the art that features of the disclosed embodiments can be combined, rearranged, etc., to produce additional embodiments within the scope of the invention, and that various other changes, omissions, and additions may be made therein and thereto, without parting from the spirit and scope of the present invention.

What is claimed is:

1. An automatic membrane tension adjustment system for a membrane whose surface tension is adjusted using tension rods, said system comprising:

tension rod adjustment members that are configured to releasably join with tension rods and rotate the tension rods;

motors joined with said tension rod adjustment members, said motors configured to automatically rotate said tension rod adjustment members;

vibration sensors, each of which is configured to be positioned on a membrane to measure a vibration frequency at a position on the membrane;

an automatic excitation member configured to cause a membrane to resonate; and a control module for controlling said automatic excitation member and said motors based on data received from said vibration sensors.

2. The system according to claim 1, wherein said motors are joined with a first gear.

3. The system according to claim 1, wherein each of said vibration sensors is positioned on said membrane adjacent a tension rod.

4. The system according to claim 2, each of said tension rod adjustment members further comprising:

a second gear axially mounted with respect to a longitudinal axis of said member; and a mechanism for engaging and disengaging said first and second gears.

5. The system according to claim 4, wherein said first gear is a worm gear, said second gear is a spur gear, said worm and spur gears being configured to provide a predetermined torque.

6. The system according to claim 4, wherein said tension rod adjustment members are configured so as to be rotatably adjustable when said first and second gears are disengaged to allow said members to be joined with said rods regardless of said rods axial position.

7. The system according to claim 1, wherein said vibration sensors piezoelectric transducers.

8. The system according to claim 1, wherein said automatic excitation member includes a solenoid mechanism or similar.

9. The system according to claim 1, further comprising:

a mechanical frame including adjustable and lockable arms joined by a center portion, each of said arms configured to receive said tension rod adjustment members, said motors, said vibration sensors, said automatic excitation member, and said control module.

10. The system according to claim 1, further comprising:

a visual display adjacent each of said vibration sensors for displaying said vibration frequencies measured by said sensors.

11. An automatic drum tuning system for a drum having a drum head mounted between a drum shell and a drum hoop using threaded tension rods inserted through holes in the drum hoop that are joined to threaded lugs that are connected to the drum shell, said system comprising:

tension rod adjustment members that are configured to releasably join with tension rods and rotate the tension rods;

motors joined with said tension rod adjustment members, said motors configured to automatically rotate said tension rod adjustment members;

vibration sensors, each of which is configured to be positioned on a drum head to measure a vibration frequency on the drum head;

an automatic excitation member configured to cause a drum head to resonate; and a control module for controlling said automatic excitation member and said motors based on data received from said vibration sensors.

12. The system according to claim 11, wherein said motors are joined with a first gear.

13. The system according to claim 11, wherein each of said vibration sensors is positioned on the drum head adjacent a tension rod to measure a vibration frequency adjacent the tension rod.

14. The system according to claim 12, each of said tension rod adjustment members further comprising:

a second gear axially mounted with respect to a longitudinal axis of said member; and a mechanism for engaging and disengaging said first and second gears.

15. The system according to claim 14, wherein said tension rod adjustment members are configured so as to be rotatably adjustable when said first and second gears are disengaged to allow said members to be joined with said rods regardless of said rods axial position.

16. The system according to claim 11, wherein said vibration sensors are piezoelectric transducers.

17. The system according to claim 11, wherein said automatic excitation member includes a solenoid mechanism and striking pin or similar.

18. The system according to claim 11, further comprising:

a mechanical frame including adjustable and lockable arms joined by a center portion, each of said arms configured to receive at least one of said tension rod adjustment members, said motors, said vibration sensors, and said center portion configured to receive said automatic excitation member.

19. The system according to claim 11, further comprising:

a visual display in communication with each of said vibration sensors for displaying said vibration frequencies measured by said sensors.

20. A method of automatically tuning a drum having a drum head mounted between a drum shell and a drum hoop using threaded tension rods inserted through holes in the drum hoop that are joined to threaded lugs that are connected to the drum shell, said method comprising:

(a) exciting a drum head to cause it to resonate;

(b) sensing a vibration frequency at one or more points relative to each tension rod;

(c) determining a global average vibration frequency of said vibration frequencies for said points relative to each tension rod;

(d) comparing said vibration frequencies of each of said points relative to each tension rod to said global average vibration frequency to determine a correction value for each point relative to said global average vibration frequency;

(e) automatically turning each tension rod based on said correction value for said points relative to each tension rod;

(f) automatically repeating steps (a)-(e) until each of said vibration frequencies of each of said points relative to each tension rod is substantially similar; and (g) automatically turning each tension rod in a uniform direction substantially simultaneously.

* * * * *